US007579794B2

(12) United States Patent
Chang et al.

(10) Patent No.: US 7,579,794 B2
(45) Date of Patent: Aug. 25, 2009

(54) FAN SYSTEM WITH HYSTERESIS CHARACTER AND METHOD THEREOF

(75) Inventors: Chien-Lung Chang, Taipei (TW); Chao Chen, Taipei (TW); Kuo-Chung Kao, Taipei (TW)

(73) Assignee: ASUSTeK Computer Inc., Taipei (TW)

( * ) Notice: Subject to any disclaimer, the term of this patent is extended or adjusted under 35 U.S.C. 154(b) by 196 days.

(21) Appl. No.: 11/713,706

(22) Filed: Mar. 5, 2007

(65) Prior Publication Data

US 2007/0224030 A1 Sep. 27, 2007

(30) Foreign Application Priority Data

Mar. 22, 2006 (TW) ..... 95109903 A

(51) Int. Cl.
*H02K 21/00* (2006.01)
*H02K 31/00* (2006.01)

(52) U.S. Cl. ..... 318/254; 318/471; 318/473; 62/229

(58) Field of Classification Search ..... 318/471, 318/473, 400.38, 244, 246; 62/126, 229; 417/22, 32; 327/205
See application file for complete search history.

(56) References Cited

U.S. PATENT DOCUMENTS 4,280,332 A * 7/1981 Khan et al. ..... 62/156
4,297,851 A * 11/1981 Paddock et al. ..... 62/126
4,350,023 A * 9/1982 Kuwabara et al. ..... 62/176.6
4,380,155 A * 4/1983 Paddock et al. ..... 62/229
4,494,526 A * 1/1985 Wurst et al. ..... 126/585
4,556,171 A * 12/1985 Fukami et al. ..... 237/12.3 B
4,658,120 A * 4/1987 Fujikawa ..... 219/505
4,717,811 A * 1/1988 Fujii ..... 219/497
4,734,554 A * 3/1988 Tateda et al. ..... 219/705
4,735,057 A * 4/1988 Janke ..... 62/187
4,813,241 A * 3/1989 Hurutachi et al. ..... 62/209
5,610,545 A * 3/1997 Jenkins et al. ..... 327/205
5,617,050 A * 4/1997 Jenkins et al. ..... 327/205
5,718,373 A * 2/1998 Kim et al. ..... 236/35
5,726,874 A * 3/1998 Liang ..... 363/141
5,920,264 A * 7/1999 Kim et al. ..... 340/584
6,020,700 A * 2/2000 Tien ..... 318/400.38
6,038,872 A * 3/2000 Nojiri et al. ..... 62/140

(Continued)

FOREIGN PATENT DOCUMENTS

CN 1204030 A 1/1999

(Continued)

*Primary Examiner*—Paul Ip
(74) *Attorney, Agent, or Firm*—Winston Hsu

(57) ABSTRACT

A fan system includes a fan, a hysteresis circuit including a temperature sensor, a first operational amplifier having a negative input end coupled to the temperature sensor, and a second operational amplifier having a negative input end coupled to an output end of the first operational amplifier and having a positive input end coupled to a power supply for outputting a first voltage when the temperature sensed by the temperature sensor is greater than a first temperature, and for outputting a second voltage when the temperature sensed by the temperature sensor is lower than a second temperature. The fan system further includes a fan switch coupled to the hysteresis circuit and the fan for controlling a rotational speed of the fan according to the first voltage or the second voltage outputted from the hysteresis circuit. The first temperature is greater than the second temperature.

13 Claims, 7 Drawing Sheets

U.S. PATENT DOCUMENTS 6,135,718 A * 10/2000 Yang ..... 417/22
6,385,395 B1 * 5/2002 Horng et al. ..... 388/809
6,407,525 B1 * 6/2002 Horng et al. ..... 318/473
6,515,447 B2 * 2/2003 Horng et al. ..... 318/807
6,551,065 B2 * 4/2003 Lee ..... 417/32
6,617,815 B1 * 9/2003 Krief ..... 318/471
6,665,163 B2 12/2003 Yanagisawa

FOREIGN PATENT DOCUMENTS

| | | | |
|---|---|---|---|
| CN | 2458664 | Y | 11/2001 |
| GB | 2324887 | | 11/1998 |
| JP | 58-123039 | A | 7/1983 |
| TW | 494214 | | 7/2002 |

* cited by examiner

FAN SYSTEM WITH HYSTERESIS CHARACTER AND METHOD THEREOF

BACKGROUND OF THE INVENTION

1. Field of the Invention

The present invention relates to a method and fan system with a hysteresis character, and more particularly, to a method and fan system that utilizes different temperature threshold values to switch on the fan (or to increase the fan rotational speed) and to switch off the fan (or to decrease the fan rotational speed).

2. Description of the Prior Art

Display efficiency of computer systems are improving in the development of multi-media technology. In general, in order to assure the normal operation of the display card, display card manufacturers tend to set the related settings of the display cards within a safety range before shipping the cards, for example, an operation frequency and an operation voltage of a graphic processing unit tends to be lower than the maximum frequency and the maximum voltage acceptable for the graphic card. In this situation, some users will increase or decrease the operation frequency of the graphic processing unit according to different software to obtain different image processing efficiency. However, the temperature of the display card increases when the graphics-processing unit is processing a complex image calculation (such as 3D image processing). The graphic processing unit generates and emits more heat when executing a normal 2D image.

A conventional method of utilizing fan to cool the heat generated from a graphic processing unit, the method initials a fan when the temperature is above a predetermined temperature and turns off the fan when the temperature is below the predetermined temperature and usually the fan only turns on to cool down the graphic processing unit when the display card is on a heavy load and generating a great amount of heat. Normally, when the display card is at a light load, a heat sink or heat pipe is utilized to release the heat generated by the graphic processing unit. However, the one-step switch method causes the fan to rotate and stop within a short time. Please refer to FIG. 1. FIG. 1 illustrates a diagram of a fan switch corresponding to temperature of a conventional display card. The fan is switched on when the display card is on a heavy load and the temperature is greater than T1 (point A), after a while when the temperature drops below T1 (point B), the fan is then switched off, as the display card is still on the heavy load status the temperature quickly rises above T1 again (point C), hence the fan is overused and generating unnecessary noise from being switched on and then switched off repeatedly. Additionally, this action of repeated switching reduces the life span of the fan. Furthermore, the current cooling device of the display card in the market generally requires a software developed from the allocated hardware to control the fan rotational speed, therefore the user has to further install a fan control program included with the display card in order to manage the fan rotational speed, thus this causes inconvenience to the user.

SUMMARY OF THE INVENTION

The claimed invention provides a method and fan system that utilizes different temperature threshold values to switch on the fan (or increase fan rotational speed) and to switch off the fan (or decrease fan rotational speed) to solve the above-mentioned problem.

The claimed invention discloses a fan system with a hysteresis character, the fan system comprises a fan, a temperature sensor, a first operational amplifier having a negative input end coupled to the temperature sensor, a second operational amplifier having a negative input end coupled to an output end of the first operational amplifier and having a positive end of the second operational amplifier coupled to a power supply for outputting a first voltage when the temperature sensed by the temperature sensor is greater than a first temperature, and for outputting a second voltage when the temperature sensed by the temperature sensor is lower than a second temperature, and a fan switch coupled to the hysteresis circuit and the fan for controlling a rotational speed according to the first voltage or the second voltage outputted by the hysteresis circuit, wherein the first temperature is greater than the second temperature.

The claimed invention discloses an interface capable of controlling fan rotational speed according to temperature change, the interface comprises at least one electronic component, the electronic component generates different temperatures according operation condition, a fan, a hysteresis circuit comprises a temperature sensor coupled to the electronic component, a first operational amplifier has a negative input end coupled to the temperature sensor, and a second operational amplifier has a negative input end coupled to an output end of the first operational amplifier, and a positive input end of the second operational amplifier coupled to a power supply for outputting a first voltage when the temperature sensed by the temperature sensor is greater than a first temperature, and for outputting a second voltage when the temperature sensed by the temperature sensor is lower than a second temperature. The interface further comprises a fan switch coupled to the hysteresis circuit and the fan, the fan switch is utilized for controlling the fan rotational speed according to the first voltage or the second voltage outputted by the hysteresis circuit, wherein the first temperature is greater than the second temperature.

The claimed invention discloses a method of controlling fan rotational speed according to temperature detected, the method comprises the following steps: controlling the fan to switch from a first speed to a second speed when the temperature sensed rises from below a first temperature to the first temperature, and controlling the fan to switch from the second speed to a third speed when the temperature sensed falls from above a second temperature to the second temperature, wherein the first temperature is greater than the second temperature.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
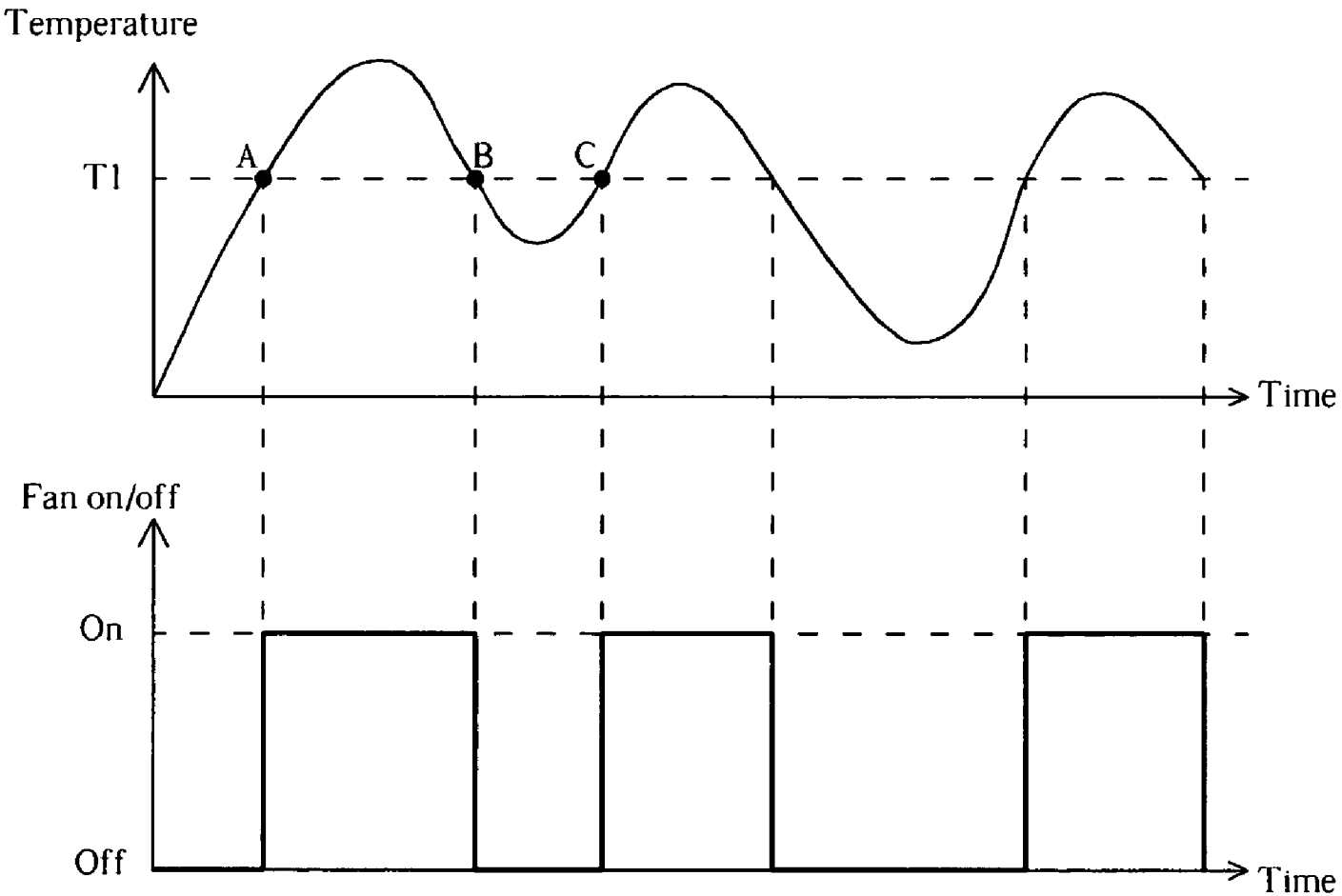
Fig. 1 Prior Art
FIG. 1 illustrates a diagram of a fan switch corresponding to temperature of a conventional display card.
Figure 2:
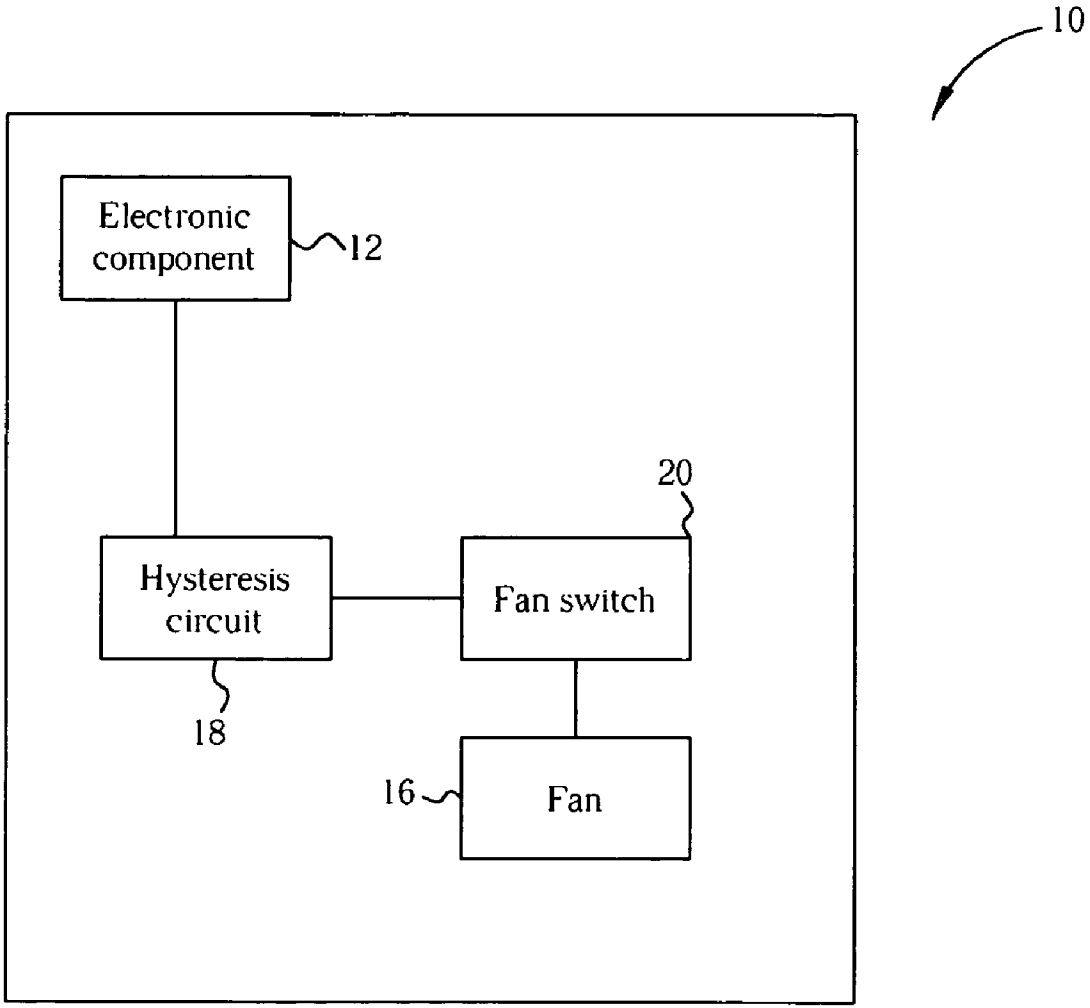
FIG. 2 illustrates a functional block diagram of an interface capable of controlling fan rotational speed according to temperature change.

Please refer to FIG. 2. FIG. 2 illustrates a functional block diagram of an interface 10 capable of controlling fan rotational speed according temperature change. The interface 10 can be interfaces such as a VGA card, a wireless LAN card, wherein the interface 10 further includes an electronic component 12, the electronic component 12 for example can be a processor such as a graphic processing unit in the VGA card, or a network processing unit in the wireless LAN card, the type of processor is not limited in the present invention, the electronic component 12 is a component that can rises to a high temperature when operating such as an ASIC or a FPGA; a hysteresis circuit 18 is coupled to the electronic component 12 wherein the hysteresis circuit 18 is capable of outputting corresponding control signal according to the temperature of the electronic component 12, for example, (1) when the temperature of the electronic component 12 is higher than a first temperature, the hysteresis circuit 18 outputs a first voltage, (2) when the temperature of the electronic component 12 is lower than a first temperature, the hysteresis circuit 18 continues to output the first voltage, (3) when the temperature of the electronic component 12 drops to a second temperature which is lower than the first temperature, the hysteresis circuit 18 then recovers an original output voltage that is a second voltage. In step (2), the hysteresis circuit 18 continues to output the first voltage, and the hysteresis circuit 18 in step (3) then recovers the original output voltage, these two steps explain a hysteresis phenomenon that occurred between input and output relationship; a fan switch 20 is coupled to the hysteresis circuit 18 wherein the fan switch 20 produces different switch responses according to the hysteresis circuit 18 output, such as in the previous example, the hysteresis circuit 18 outputs the first voltage and the second voltage, and the switch circuit is capable of controlling the corresponding on and off respectively according to the first voltage and the second voltage; and a fan 16 is coupled to the fan switch 20 and generating corresponding fan rotational speed according to the fan switch 20. In using the previous example again, when the fan switch output is to switch on, the fan rotates to full speed, in contrary, when the fan switch output is to switch off, the fan rotational speed is 0 (which means to stop rotating). Please take note that the hysteresis circuit 18, the fan switch 20, and the fan 16 are not limited to situations of on and off only, there can even be three or more situations possible, for example, the hysteresis circuit 18 is capable of utilizing a tandem circuit, parallel circuit, or simple circuit concept to output a third voltage, and the fan switch 20 produces a corresponding third switch according to the hysteresis circuit 18 output, or the fan switch can tandem connect or parallel connect to different impedance to output three different voltages, lastly the fan 16 can generate corresponding fan rotational speed according the different voltages outputted by the fan switch 20.

Figure 3:
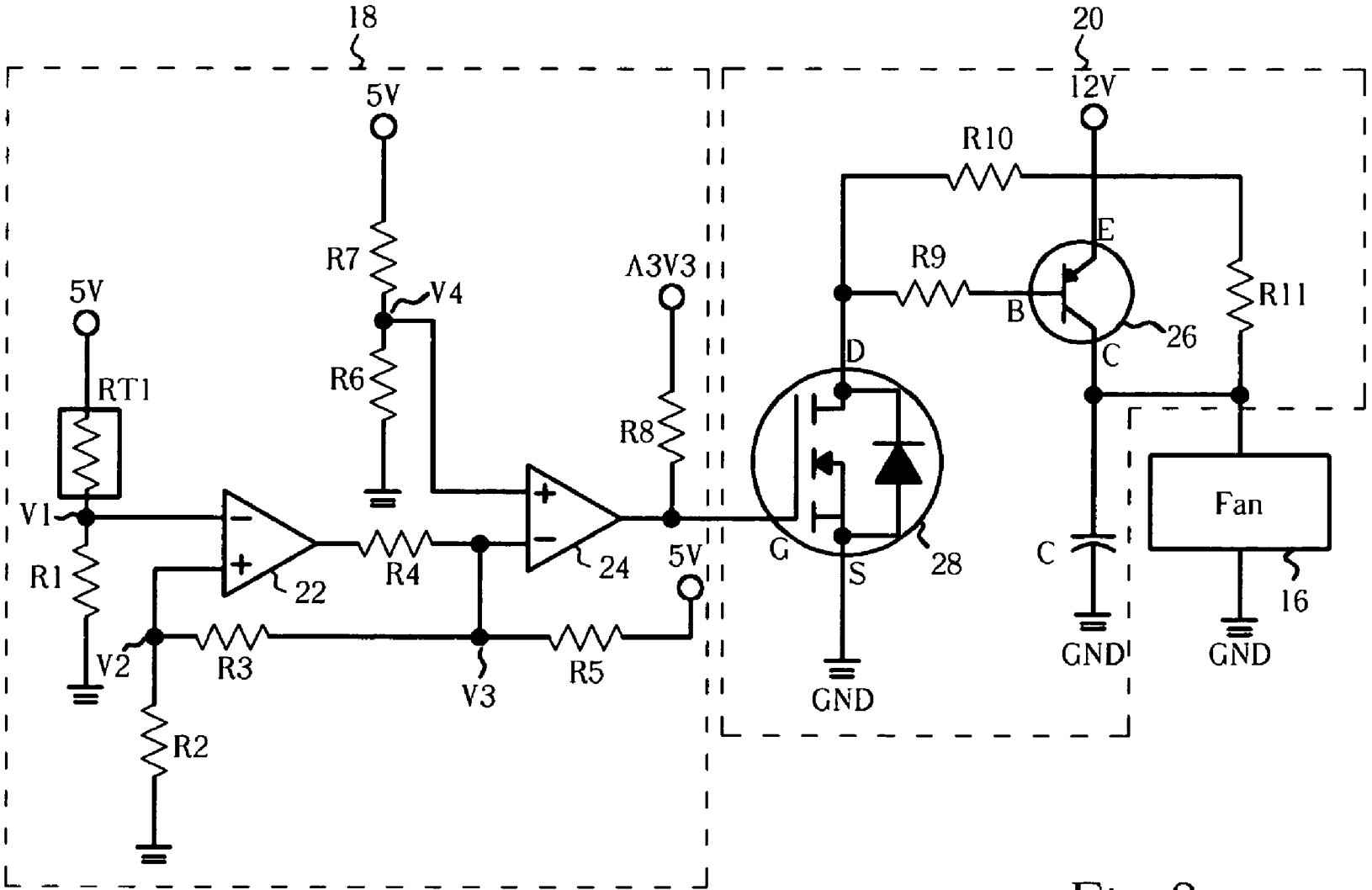
FIG. 3 illustrates a circuit diagram explaining operation of a hysteresis circuit, a fan switch, and a fan according to one embodiment of the present invention.

Please refer to FIG. 3. FIG. 3 illustrates a circuit diagram explaining the operation of a hysteresis circuit 18, a fan switch 20, and a fan 16 according to one embodiment of the present invention, wherein the hysteresis circuit 18 utilizes a Schmitt trigger circuit design concept. The hysteresis circuit 18 includes a first operational amplifier 22, a heat-sensitive resistor RT1, resistors R1, R2, R3, R4, R5, R6, R7, a pull-high resistor R8, and a second operational amplifier 24, wherein the heat-sensitive resistor RT1 can be a negative temperature coefficient heat-sensitive resistor, which means that when the temperature rises the resistance value becomes smaller, when the temperature drops then resistance value becomes greater, an end of the heat-sensitive resistor RT1 is coupled to a power supply, the power supply can be a 5V internal power supply provided by a computer device, another end of the heat-sensitive resistor RT1 is coupled to a negative input end of the first operational amplifier 22 and the resistor R1; the negative input end of the first operational amplifier 22 is coupled to the heat-sensitive resistor RT1, a positive input end of the first operational amplifier 22 is coupled to the resistors R2, R3, the output end is coupled to the resistor R4, wherein when potential of the positive input end of the first operational amplifier 22 is higher than potential of the negative input end, the output end is open, when the potential of the negative input end of the first operational amplifier 22 is higher than the potential of the positive input end, a low level control signal is outputted; a negative input end of the second operational amplifier 24 is coupled to the output end of the first operational amplifier 22 through the resistor R4, a positive end of the second operational amplifier 24 is coupled to the resistors R6, R7, the resistor R7 is coupled to a power supply, the power supply can be a 5V internal power supply provided by the computer device, an output end of the second operational amplifier 24 is coupled to the high-pull resistor R8 and the fan switch 20, wherein when potential of the positive input end of the second operational amplifier 24 is higher than potential of the negative input end, the output end is open, when the potential of the negative input end of the second operational amplifier 24 is higher than potential of the positive input end, a low level control signal is outputted; an end of the high-pull resistor R8 is coupled to the output end of the second operational amplifier 24, another end of the high-pull resistor R8 is coupled to a power supply for enhancing bias voltage of the fan switch 20 when the output end of the second operational amplifier 24 is open; furthermore, the resistor R5 is coupled to a power supply, the power supply is a 5V internal power supply provided by the computer device.

The fan switch 20 includes a bipolar junction transistor 26, the bipolar junction transistor 26 includes an emitter, a collector, and a base, and the bipolar junction transistor 26 can be replaced by a metal-oxide semiconductor (MOS) transistor. The fan switch 20 further includes a MOS transistor 28; the MOS transistor includes a source, a drain, and a gate, which can be an enhanced N-channel metal-oxide semiconductor (E-NOMS) transistor. The drain is coupled to the base of the bipolar junction transistor 26 through a resistor R9 and is coupled to a power supply through a resistor R10, the power supply can be a 12V internal power supply provided by the computer device for supplying power to rotate the fan. The source is coupled to a ground end, and the gate is coupled to the output end of the second operational amplifier 24 of the hysteresis circuit 18 and the high-pull resister R8 for receiving control signals transmitted from the hysteresis circuit 18 in order to control on and off of the bipolar junction transistor 26. The fan switch 20 further includes a resistor R11 where one end is coupled to the fan 16, and another end is coupled to the power supply (12V) that is also coupled to the emitter of the bipolar junction transistor 26, and a resistor C coupled to the collector of the bipolar junction transistor 26 for storing electric charge supplied to rotate the fan 16, and for temporarily providing power to the fan 16 when the fan 16 is switching to different rotational speeds (or when switching on or off).

Please continue to refer to FIG. 3 for detailed explanation of the operation theory of controlling the fan. When the computer device of where the interface 10 is installed is switched on, according to the voltage divider theorem, the voltage values V1, V2 are:

$$V1=5*R1/(RT1+R1);$$

$$V2=5*R2/(R2+R3+R5);$$

However, as the computer has just switched on, the temperature sensed by the heat sensitive resistor RT1 is low, as the heat sensitive resistor RT1 is a negative temperature coefficient heat sensitive resistor, therefore the value of the heat sensitive resistor RT1 at this time is greater such that V1, V2, wherein the obtained value and temperature threshold values (the first temperature and the second temperature) of R2 are related, at this time the potential of the positive input end of the first operational amplifier 22 is higher than the potential of the negative input end of the first operational amplifier, hence causing the output end to open, and according to the voltage divider theorem, the voltage values V3(+) and V4 are:

$$V3(+)=5*(R2+R3)/(R2+R3+R5);$$

$$V4=5*R6/(R6+R7);$$

In the allocation of size of each resistance value causes V4<V3 (+), at this time the potential of the positive input end of the second operational amplifier 24 is lower the potential of the negative input end of the second operational amplifier 24, and a low level control signal (0V) is outputted, therefore at this time, the bipolar junction transistor 26 is disconnected, as the fan 16 is coupled to a 12V power supply through a resistor R11, the fan 16 rotates at a low speed of a first rotational speed, wherein setting of the resistor R11 can be set to control the first rotational speed accordingly, as the resistor R11 of a greater resistance value can set the first rotational speed to a low rotational speed. Furthermore, if the resistor R11 is not installed within the fan switch 20, which means that if the resistor R11 of FIG. 3 is a broken circuit, the fan 16 cannot receive the 12V power supply, the fan 16 is switched off and the first rotational speed becomes 0.

However, when the user is executing a complex program, such as 3D image processing, at this time when the workload of the interface 10 increases, the rise in temperature is sensed by the heat sensitivity resistor RT1, the change in temperature is feedback through the resistance value of the heat sensitive resistor RT1, the rise in temperature causes the resistance of the heat sensitive resistor RT1 to reduce and causes V1 to increase, when V1 increases to V1>V2, which means that the temperature sensed by the heat sensitive resistor RT1 rises from below the first temperature to the first temperature, at this time the potential of the positive input end of the first operational amplifier 22 is lower than the potential of the negative input end of the first operational amplifier 22, hence the low level control signal (0V) is outputted, and according to the voltage divider theorem the voltage values V2 (−), V3 (−), V4 are:

$$V3(-)=5*((R2+R3)//R4)/(((R2+R3)//R4)+R5);$$

$$V2(-)=V3(-)*R2/(R2+R3);$$

$$V4=5*R6/(R6+R7);$$

In consideration to V3 (−) added to the resister R4 parallel connection such that V3 (−)<V4, wherein R6, R7 can be selected so that V4 is positioned in between two low level voltages V3 (+) and V3 (−), at this time the potential of the positive input end of the second operational amplifier 24 is higher than the potential of the negative input end of the second operational amplifier 24, hence the output end is open, the high-pull resistor R8 and the coupled power supply enhance bias voltage of the gate of the MOS transistor, and the hysteresis circuit 18 then outputs the first voltage to the fan switch 20, the MOS transistor 18 is switched-on which also causes the bipolar junction transistor 26 to switch on too, at this time the fan 16 switches from the first speed of a low speed to the second speed of a higher speed. Furthermore, if the fan switch 20 is not installed within the resistor R11, it means that if the resistor R11 of FIG. 3 is a broken circuit, the fan 16 switches from an off status to a rotating status.

The rotation of the fan 16 causes the temperature to drop, the heat sensitive resistor RT1 detects the fall in temperature and the resistance value of the heat sensitive resistor RT1 increases, as V1 decreases, when V1 decreases to V1<V2 (−), which means that when the temperature detected by the heat sensitive resistor RT1 falls from a temperature greater than the second temperature to the second temperature, the potential of the positive input end of the first operational amplifier 22 is greater than the potential of the negative input end of the first operational amplifier 22, and a low level control signal (0V) is outputted, the hysteresis circuit 18 then outputs the second voltage to the fan switch 20, at this time the MOS 28 is switched off which also causes the bipolar junction transistor 22 to switch off, as the fan 16 is coupled to the 12V power supply through the resistor R11, the fan 16 switches from the second speed to the first speed. Furthermore, if the fan switch 20 is not installed within the resistor R11, it means that the resistor R11 of FIG. 3 is a broken circuit, at this time the fan 16 cannot receive the 12V power supply, thus the fan 16 is switched off and the first speed becomes 0.

Figure 4:
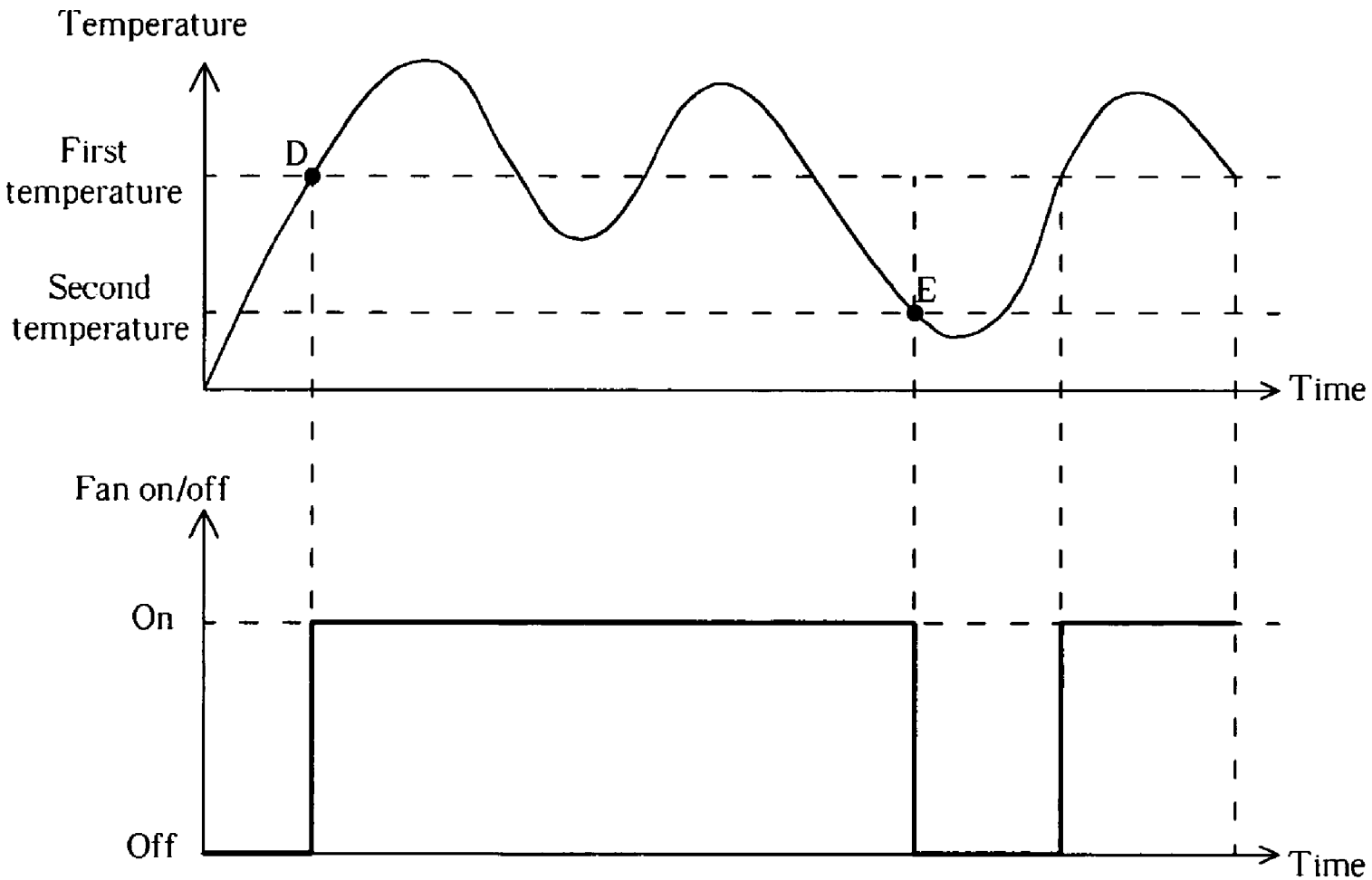
FIG. 4 illustrates a graph of interface temperatures corresponding to switching rotational speeds and a graph of interface temperatures corresponding to on and off of a fan.

Please refer to FIG. 4. FIG. 4 illustrates a diagram of temperature an interface 10 corresponding to switching rotational speed or on and off of a fan 16. When the temperature of the interface 10 is greater than the first temperature (point D), for example, in a first embodiment controlling the fan 16 to switch on or increasing rotational speed, the temperature can be 80 degrees centigrade, and when the temperature of the interface 10 is less than the second temperature (point E), for example, in a second embodiment controlling the fan 16 to switch off or reducing rotational speed, the temperature can be 51 degrees centigrade, here the first temperature and the second temperature are not restricted as the temperature can be set to a possible highest operation temperature, a lowest operation temperature endured by the electronic component or set to an optimum operation temperature range as a base. In the above-mentioned, the hysteresis circuit of the present invention can allow the interface 10 to be at a status of a fan not rotating or rotating at a low speed most of the time, the fan 16 initiates when the temperature rises above the first temperature or increases rotational speed to perform cooling. The fan 16 shuts down or decreases rotational speed when the temperature drops to a certain degree (less than the second temperature), hence the present invention overcomes the problem of sudden on and off or rotating in a sudden fast or slow speed in order to achieve low noise pollution as well as extending the lifespan of the fan 16.

Figure 5:
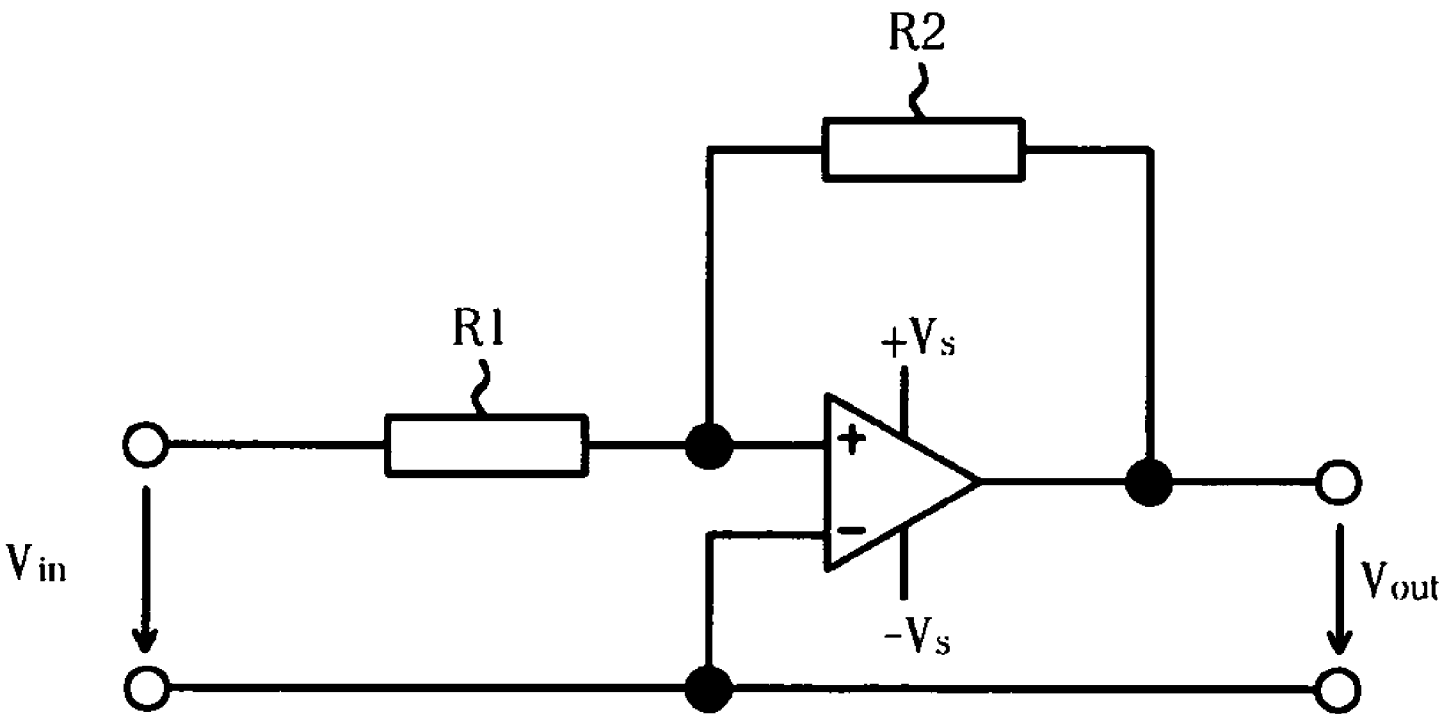
FIG. 5 illustrates a diagram of a hysteresis circuit according to another embodiment of the present invention.
Figure 6:
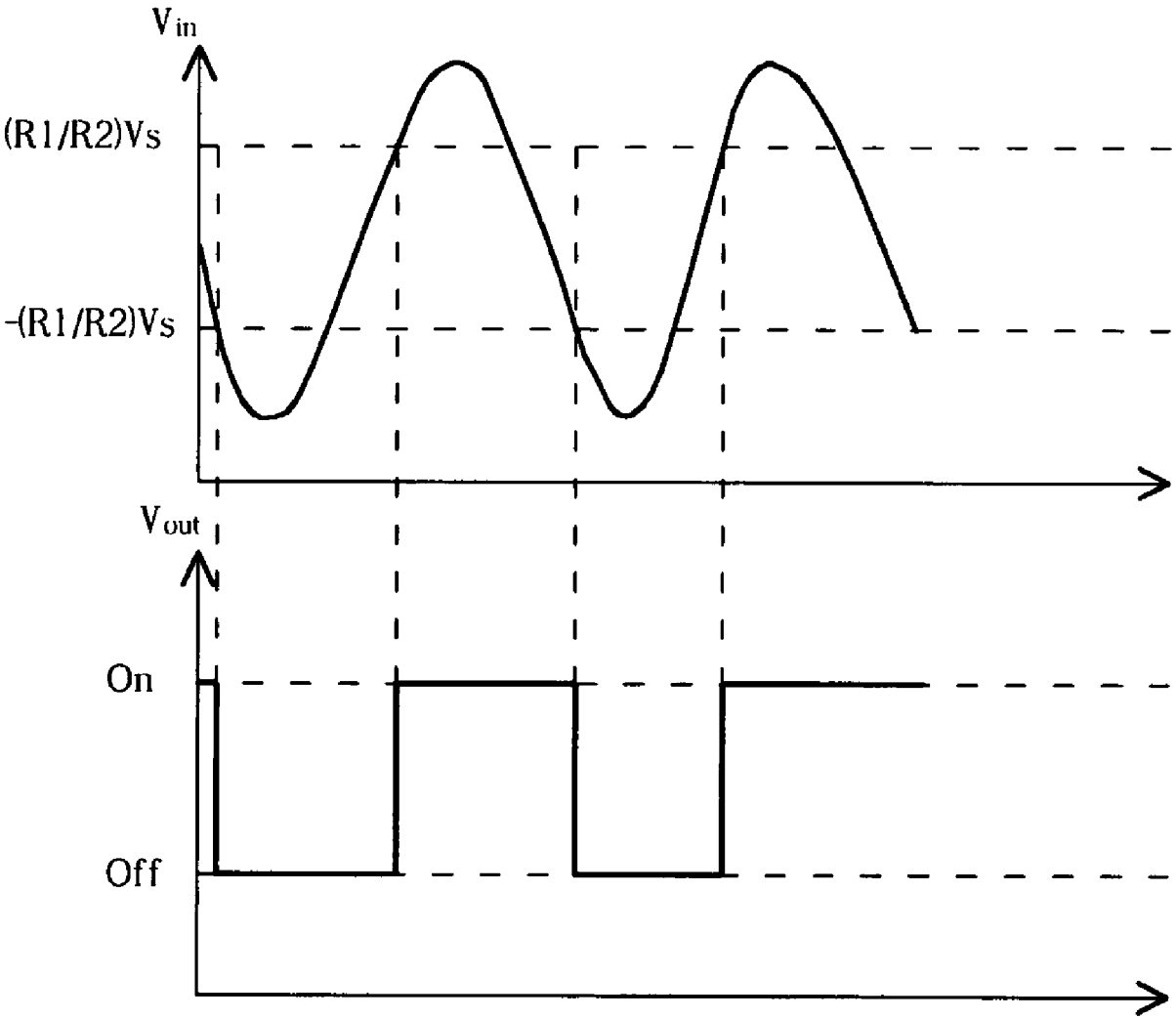
FIG. 6 illustrates a relationship diagram of Vin and Vout corresponding to the hysteresis circuit of FIG. 5.
Figure 7:
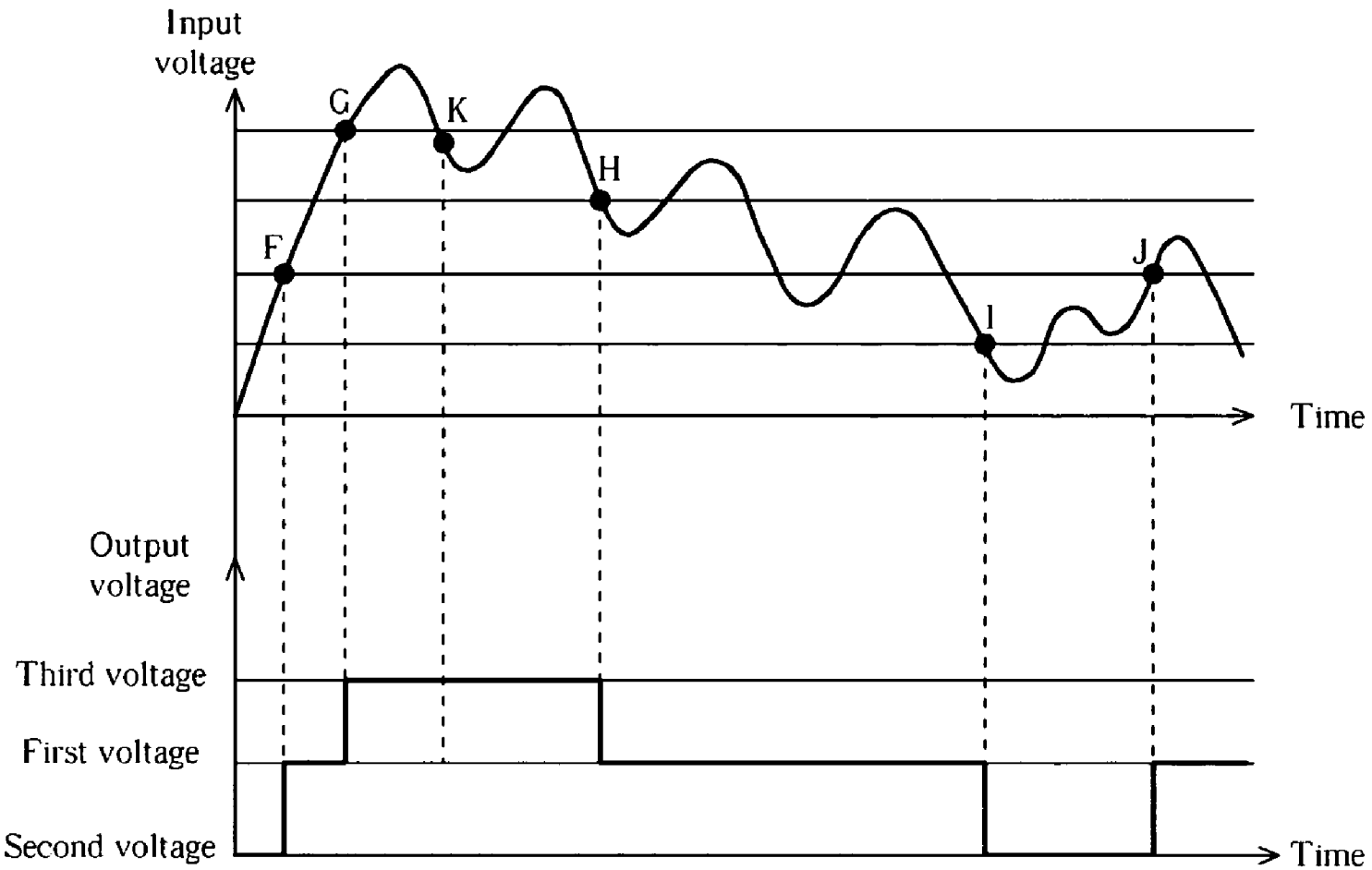
FIG. 7 illustrates a relationship diagram of inputting voltage and outputting voltage of a hysteresis circuit according to another embodiment of the present invention.

The design of initiating (or increasing fan rotational speed) and shutting down (or decreasing fan rotational speed) of the hysteresis circuit of the present invention can be applicable to any fan control module, for example, a fan control module of a display card or other interface card having a fan such as a cooling fan interface card; furthermore the embodiment of the present invention is not limited to only the above-mentioned and can be applicable to realize other hardware design. For example, please refer to FIG. 5 and FIG. 6. FIG. 5 illustrates a diagram of a hysteresis circuit according to another embodiment of the present invention. FIG. 6 illustrates a relationship diagram of Vin and Vout corresponding to the hysteresis circuit of FIG. 5. The hysteresis circuit of FIG. 5 can be realized by utilizing a Schmitt trigger circuit. When Vin is greater than (R1/R2)*Vs, output of Vout is on; when Vin is less than −(R1/R2)*Vs, output of Vout is off, two different threshold values ((R1/R2)*Vs, −(R1/R2)*Vs) can be utilized to achieve the on and off function. In conclusion, to the above-mentioned, the hardware design and method the hysteresis circuit of an operational amplifier to initiate the fan (or increase rotational speed) and shut down (or decrease rotational speed) belongs to the metes and bounds of the present invention. Please refer to FIG. 7. FIG. 7 illustrates a relationship diagram of inputting voltage and outputting voltage of a hysteresis circuit according to another embodiment of the present invention. FIG. 7 illustrates the three level hysteresis circuit outputting three voltages, and as is known to those skilled in the art, the voltages can be obtained easily by utilizing the embodiment of FIG. 5, therefore the following will not be reiterated. When input voltage (corresponding to the temperature of the electronic component) is higher than point F, a switch outputs a first voltage, and when the input voltage is lower than point I, the switch outputs a second voltage; similarly, when the input voltage is higher than point G, the switch outputs a third voltage, and when the input voltage is lower than point H, the switch outputs the first voltage. Take note that for a multi-level fan rotational speed control, for example the first voltage is outputted when the input voltage is higher than point F, the third voltage is outputted when the input voltage is higher than point G, noise caused by the drastic change in rotational speed can be reduced, moreover if the input voltage is not higher than point Gm, the first voltage is outputted, if the input voltage is higher than point G, the third voltage is outputted, if the input voltage is at point K which is lower than point G, the first voltage is outputted, hence the above-mentioned conforms to the characteristics of the hysteresis circuit of the present invention.

In comparison to the conventional fan control module, the fan control module of the present invention utilizes different temperature threshold values as on (or increase rotational speed) and off (decrease rotational speed) of the fan. In this way, the problem of sudden on and off or rotating in a sudden fast or slow speed can be avoided so that the objective of noise reduction and extending the lifespan of the fan can be achieved. Furthermore, the present invention is realized in a hardware manner, thus the user is not required to install additional fan control program to manage the fan rotational speed and also the present invention provides more convenience for the user.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A fan system with hysteresis character, the fan system comprising:

a fan;

a hysteresis circuit comprising:

a temperature sensor;

a first operational amplifier having a first negative input end coupled to the temperature sensor and a first output end; and a second operational amplifier having a second negative input end coupled to the first output end and having a second positive end coupled to a first power supply for outputting a first voltage when the temperature sensed by the temperature sensor is greater than a first temperature, and for outputting a second voltage when the temperature sensed by the temperature sensor is lower than a second temperature and a second output end; and a fan switch comprising a metal-oxide semiconductor (MOS) coupled to the hysteresis circuit and the fan for controlling a rotational speed according to the first voltage or the second voltage outputted by the hysteresis circuit;

wherein the first temperature is greater than the second temperature.

2. The fan system of claim 1 wherein when power level of a first positive input end is greater than power level of the first negative input end, the first output end is open, and when power level of the second positive input end is higher than the power level of the second negative input end, the second output end is open.

3. The fan system of claim 1 wherein the hysteresis circuit further comprises a pull-high resistor coupled to the second output end and a second power supply for enhancing the voltage of the fan switch when the second output end is open.

4. The fan system of claim 1 wherein the temperature sensor is a negative temperature coefficient heat sensitive conductance.

5. The fan system of claim 1 wherein the fan system further comprises:

a bipolar junction transistor comprising an emitter, a collector, and a base, the emitter being coupled to a third power supply, and the collector being coupled to the fan;

wherein the MOS comprises a source, a drain, and a gate, the drain being coupled to the base of the bipolar junction transistor, the source being coupled to a ground end, and the gate being coupled to the hysteresis circuit for receiving voltage signals transmitted from the hysteresis circuit in order to control on and off of the bipolar junction transistor.

6. The fan system of claim 5 wherein the fan switch further comprises a resistor, an end of the resistor coupled to the fan, another end of the resistor coupled to the third power supply that is also coupled to the emitter of the bipolar junction transistor.

7. The fan system of claim 5 wherein the fan system further comprises a capacitance coupled to the collector of the bipolar junction transistor for storing electric charge supplied to rotate the fan.

8. An interface capable of controlling fan speed according to temperature change, the interface comprising:

at least one electronic component, the electronic component generating different temperatures according operation condition;

a fan;

a hysteresis circuit, comprising:

a temperature sensor coupled to the electronic component;

a first operational amplifier having a first negative input end coupled to the temperature sensor and a first output end; and a second operational amplifier having a second negative input end coupled to the first output end, and a second positive input end coupled to a first power supply for outputting a first voltage when the temperature sensed by the temperature sensor is greater than a first temperature, and for outputting a second voltage when the temperature sensed by the temperature sensor is lower than a second temperature and a second output end; and a fan switch comprising a metal-oxide semiconductor (MOS) coupled to the hysteresis circuit and the fan, the fan switch is utilized for controlling the fan speed according to the first voltage or the second voltage outputted by the hysteresis circuit;

wherein the first temperature is greater than the second temperature.

9. The interface of claim 8 wherein the temperature sensor is a negative temperature coefficient heat sensitive conductance.

10. The interface of claim 8 wherein the fan switch further comprises:

a bipolar junction transistor comprising an emitter, a collector, and a base, the emitter being coupled to a third power supply, and the collector being coupled to the fan;

wherein the MOS comprises semiconductor (MOS) a source, a drain, and a gate, the drain being coupled to the base of the bipolar junction transistor, the source being coupled to a ground end, and the gate being coupled to the hysteresis circuit for receiving voltage signals transmitted from the hysteresis circuit in order to control on and off of the bipolar junction transistor.

11. The interface of claim 10 wherein the fan switch further comprises a resistor, an end of the resistor coupled to the third power supply that is also coupled to the emitter of the bipolar junction transistor.

12. The interface of claim 10 wherein the fan switch further comprises a capacitance coupled to the collector of the bipolar junction transistor for storing electric charge supplied to rotate the fan.

13. The interface of claim 10 wherein the interface is a display interface.

* * * * *